US005330126A

United States Patent [19]

Grischenko

[11] Patent Number: 5,330,126

[45] Date of Patent: Jul. 19, 1994

[54] CUP SIDEWALL STOCK UNWIND STAND

[75] Inventor: Gregory I. Grischenko, River Edge, N.J.

[73] Assignee: James River Corporation of Virginia, Richmond, Va.

[21] Appl. No.: 866,552

[22] Filed: Apr. 10, 1992

[51] Int. Cl.[5] ..... B65H 19/10

[52] U.S. Cl. ..... 242/559; 242/560

[58] Field of Search ..... 242/58, 58.1, 58.2, 242/58.3, 58.6, 75, 75.4, 75.41, 75.42, 75.43, 75.45, 156.1; 156/157, 502, 504, 507

[56] References Cited

U.S. PATENT DOCUMENTS

| | | | |
|---|---|---|---|
| 1,401,995 | 1/1922 | Loeb | 242/75.4 |
| 2,005,037 | 6/1935 | Johancen et al. | 242/58.3 |
| 2,267,962 | 12/1941 | Tishken | 242/80 |
| 2,549,239 | 4/1951 | Robertson et al. | 242/58.6 |
| 2,557,185 | 6/1951 | Gibbs | 242/75.43 |
| 2,596,428 | 5/1952 | O'Malley | 242/75 |
| 2,991,849 | 7/1961 | Erickson | 188/72 |
| 3,262,650 | 7/1966 | Randich | 242/56.2 |
| 3,478,974 | 11/1969 | Roscoe et al. | 242/58.6 |
| 3,997,094 | 12/1976 | Aylesworth | 226/19 |
| 4,073,448 | 2/1978 | Kolosov | 242/57.1 |
| 4,077,579 | 3/1978 | Seleski et al. | 242/57.1 |
| 4,196,662 | 4/1980 | Hsu | 242/58.5 X |
| 4,386,988 | 6/1983 | Kontz | 156/502 X |
| 4,392,912 | 7/1983 | Mobley | 242/58.5 X |
| 4,543,152 | 9/1985 | Nozaka | 242/57 X |
| 4,570,870 | 2/1986 | Ito | 242/156.1 X |
| 4,638,957 | 1/1987 | Graves | 242/58.6 |
| 4,908,091 | 3/1990 | Traegaardh et al. | 242/58.2 X |
| 4,944,470 | 7/1990 | Mobley | 156/502 X |
| 4,984,750 | 1/1991 | Shigeta et al. | 242/58.1 |
| 5,133,511 | 7/1992 | Mack et al. | 242/58.1 X |

*Primary Examiner*—Daniel P. Stodola
*Assistant Examiner*—John P. Darling
*Attorney, Agent, or Firm*—Sixbey, Friedman, Leedom & Ferguson

[57] ABSTRACT

An unwind stand for unwinding rolled material is disclosed in which a movable carriage mounted on a stationary frame includes at least two roll holders adapted to support a roll of material and a shifting mechanism connected to the movable carriage for moving the carriage between a first unwinding position in which a first roll of material supported by a first roll holder is positioned for unwinding, and a second unwinding position in which a second roll of material supported by a second roll holder is positioned for unwinding. Once a roll is in the unwinding position, the shifting mechanism also functions to maintain the material unwinding from the roll in an alignment position in response to an alignment detector by making fine adjustments to the lateral position of the carriage. The unwind stand may also include a rotatable wheel connected to a carrier slidably mounted on a rodless cylinder for applying a radial braking force to the roll of material, thereby imparting tension to the unwinding material. The rotatable wheel may include a pair of friction discs surrounding a portion of the wheel which can be adjustably compressed to control the slip torque of the wheel, thereby further controlling the tension of the unwinding material.

32 Claims, 3 Drawing Sheets

CUP SIDEWALL STOCK UNWIND STAND

FIELD OF THE INVENTION

The present invention relates generally to a stand for rotatively retaining rolls of coiled sheet material while the material is unwound and, more particularly, to a novel and improved unwind stand for permitting an exhausted roll of material to be quickly and easily replaced with a stand-by roll while simultaneously aligning the web of sheet material being unwound with respect to a predetermined path position.

BACKGROUND OF THE INVENTION

Elongated sheet or stock material is used in the manufacturing of a variety of products including paper cups. Normally this sheet material is shipped and stored in the form of a roll or coil and, therefore, must be unwound to be used. Unwinding stands for rotatively supporting one or more rolls provide a simple means of feeding the web of material to the next phase of the particular manufacturing process. Usually, however, only one roll of material can be fed to the next phase and, consequently, when this roll is exhausted, the manufacturing process must be stopped so that the depleted roll can be removed and replaced by a new roll. The time spent unloading the depleted roll and properly loading the new roll results in a loss of production of the final product. As a result, numerous machines have been developed to support two rolls of material so that one roll may be unwound while the other roll is prepared and positioned for movement into an unwinding position after the first roll is depleted.

For example, U.S. Pat. No. 2,267,962 to Tishken discloses a coil holder having two roll receivers adjacent each other for holding two coils of material so that one roll can be unwound while another roll is loaded for unwinding. The roll receivers are mounted on a movable carriage which is shifted laterally relative to the direction in which the web is unwinding to position a full new roll into the unwinding position when one roll is exhausted. Thus, this machine minimizes the unloading time by limiting the delay to the time involved in moving the carriage a short distance and connecting the end of the web of the material on the full roll to the machine downstream in the process. However, this stand does not provide a simple means for maintaining the alignment of the web in the unwinding position.

Once a roll of material is properly positioned and unwinding has begun, it is usually desirable to maintain the edges of the material in alignment with some predetermined path dictated by a machine or device receiving the sheet material from the unwinding stand. Normally misalignment is caused by the web wandering laterally with respect to the its direction of unwinding and may lead to excessive waste of material, and low quality or possibly useless final products. As a result, a variety of web alignment devices for unwind stands have been designed to detect and correct the misalignment.

For example, U.S. Pat. No. 3,997,094 to Aylesworth discloses an edge alignment device using detectors for sensing the edge of a sheet material being unwound from a coil and actuating hydraulic cylinders for laterally moving the coil to maintain the sheet material in a desired alignment. U.S. Pat. Nos. 3,262,650 to Randich and 4,073,448 to Kolosov both disclose alignment devices including an air cylinder for fine positioning a roll of a web material along the central axis of the roll. Similarly, U.S. Pat. No. 4,077,579 to Seleski et al. discloses an automatic edge alignment apparatus using a photo-electric edge detector for controlling a bi-directional solenoid adapted to shift a carriage laterally to maintain web alignment. However, none of these edge alignment devices is used in conjunction with an unwind stand which permits a stand-by roll of material to be prepared and positioned for quick and easy movement into the unwinding position.

Another important function of some types of unwind stands is the ability to apply a braking force to the sheet material as it is withdrawn from the roll. This is often performed by a braking device which maintains a desired amount of tension on the material so that only the required amount of material is unwound or pulled from the roll. Since the material is pulled by the machine receiving the web from the unwind stand, without any such tension, the roll of material may rotate faster than required releasing more material from the roll than the receiving machine is ready to accept. One such tensioning device is disclosed in U.S. Pat. No. 2,596,428 to O'Malley. This device includes a brake wheel which is urged against the periphery of the roll of material and a threaded member for adjusting the braking force. Also, U.S. Pat. No. 2,991,849 to Erickson discloses a friction brake apparatus in which brake shoes are urged with variable force against a drum or disk rotating with a coil of material.

Thus, the prior art fails to disclose an unwind stand for web material which simply and effectively permits the unwinding of a first roll of material and the simultaneous loading or unloading of a second roll for quick and easy movement into the unwinding position while maintaining the alignment of the unwinding material as it is unwound.

SUMMARY OF THE INVENTION

In view of the foregoing, it is an object of the present invention to provide a novel and improved unwind stand for rolled sheet material which will allow for simple and effective unwinding of rolls of sheet material.

Another object of the invention is to provide a simplified yet effective unwind stand which minimizes the time delay during loading and unloading while maintaining the alignment of the web during unwinding.

A further object of the present invention is to provide an unwind stand having a simplified design which uses a single shifting mechanism to position a new roll of material in an unwinding position and to maintain the alignment of the web during unwinding.

Another object of the present invention is to provide an unwind stand having a shifting mechanism operated by a first actuator for quickly moving the new roll of material into an unwinding position and a second actuator for making fine adjustments to the position of the roll in the unwinding position to maintain the alignment of the material unwinding from the roll. The first and second actuators are arranged in serial relationship to allow the actuators to share the same connections between a movable frame and stationary frame.

Yet another object of the present invention is to provide an unwind stand having a simple, yet effective, tensioning system which maintains tension in the unwinding material.

A still further object of the present invention is to provide a tensioning system for an unwind stand which can be simply and accurately adjusted to vary the tension in the web of unwinding material.

The above objects of the present invention are achieved by providing a rolled material unwind stand comprising a movable frame or carriage mounted on a stationary frame which includes at least two roll holders, each adapted to support a roll of material. A shifting mechanism which is connected to the movable carriage is provided for moving the carriage between a first unwinding position in which a roll of material supported by one of the roll holders is positioned for unwinding, and a second unwinding position in which another roll of material supported by the other roll holder is positioned for unwinding. Once a roll is in the unwinding position, the shifting mechanism also functions to maintain the material unwinding from the roll in an alignment position in response to an alignment detector by making fine adjustments to the lateral position of the carriage. The unwind stand may also include a rotatable wheel connected to a piston slidably mounted on a rodless cylinder for applying a radial braking force to the roll of material, thereby providing a tensioning effect. The rotatable wheel may include a pair of friction discs surrounding a portion of the wheel which can be adjustably compressed to control the slip torque of the wheel, thereby further controlling the tension of the unwinding material.

BEST MODE FOR CARRYING OUT THE INVENTION

Figure 1:
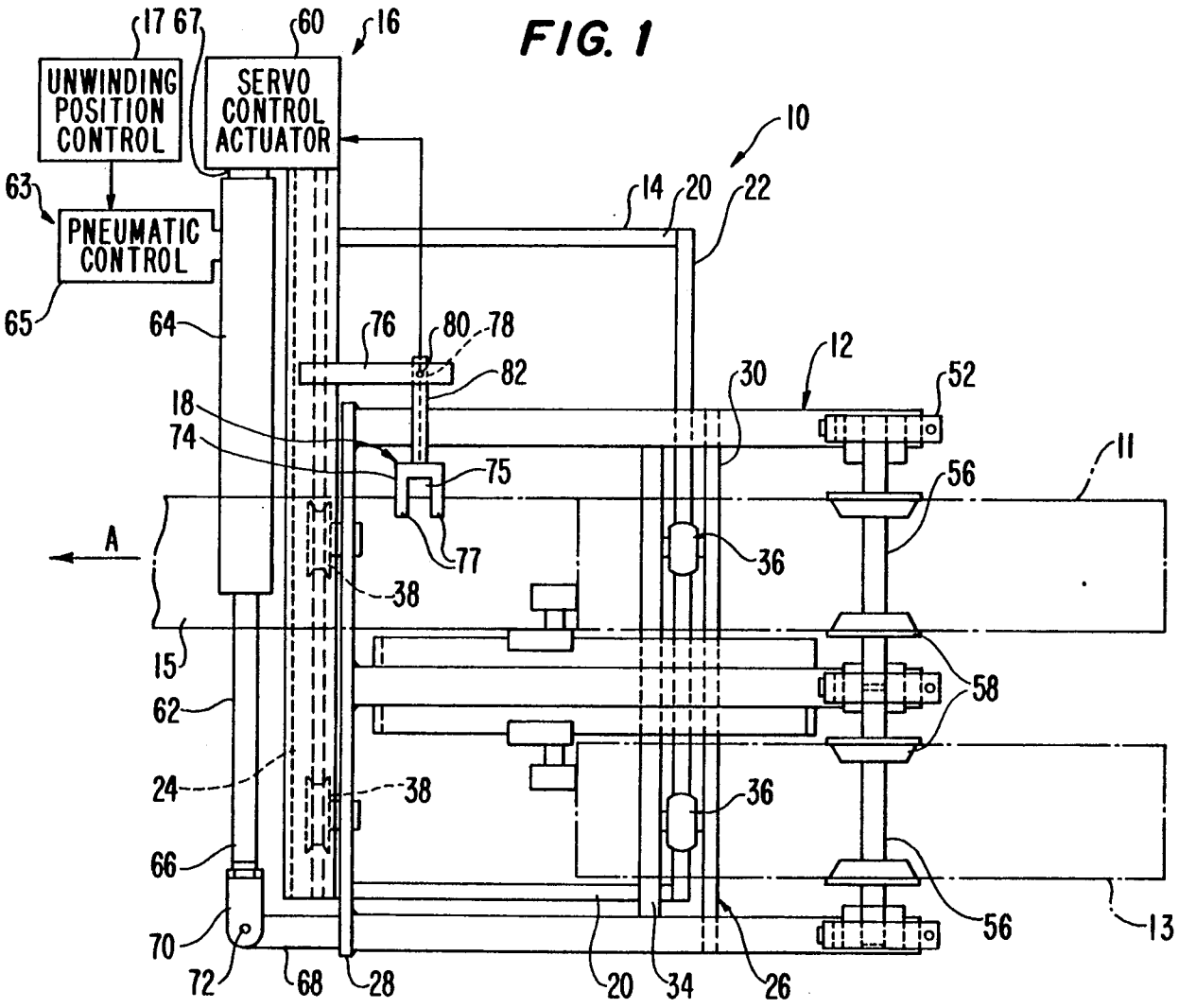
FIG. 1 is a top detailed view of the unwind stand embodying the present invention in a first unwinding position.
Figure 2:
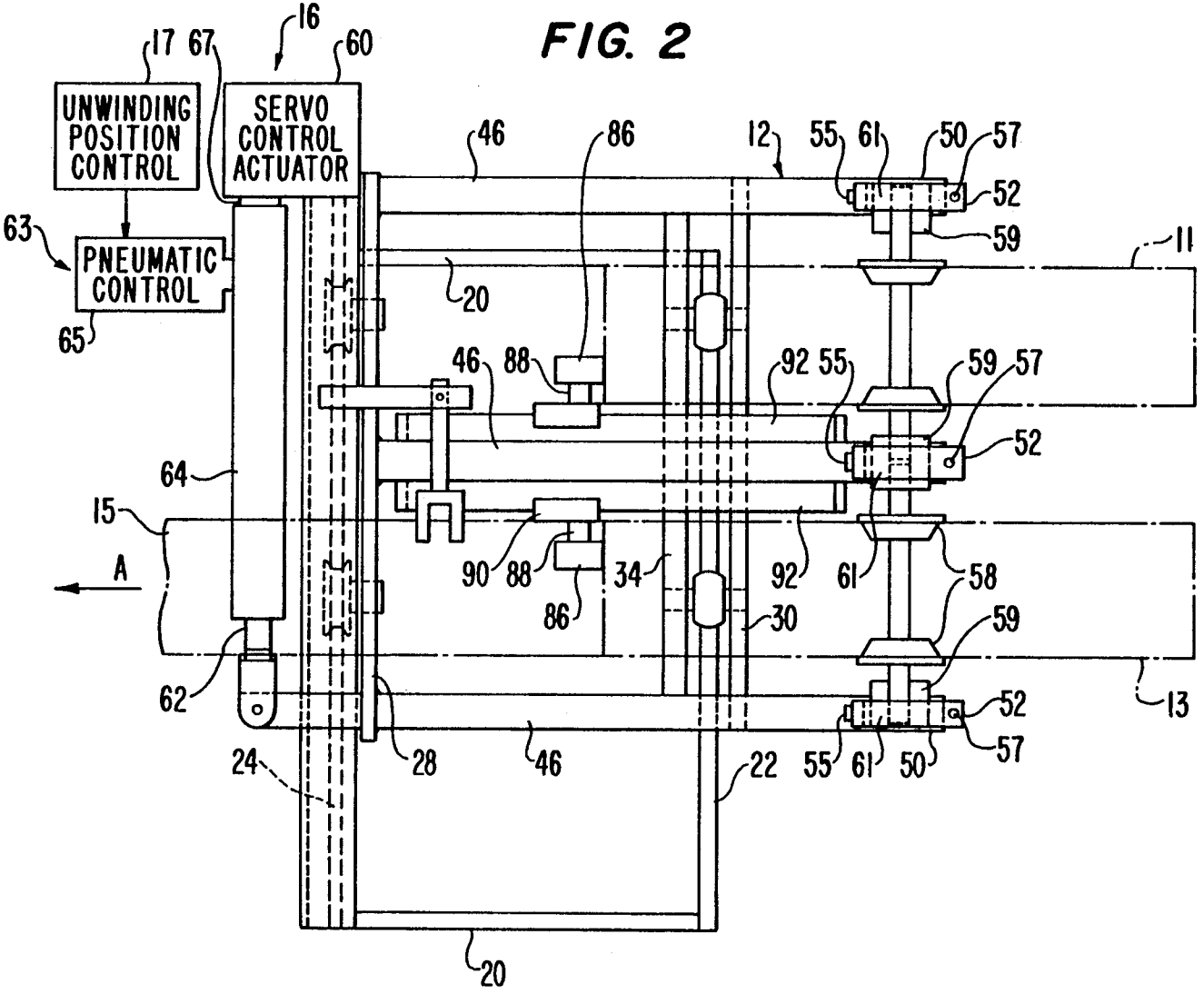
FIG. 2 is a top detailed view of the unwind stand embodying the present invention in a second unwinding position.
Figure 3:
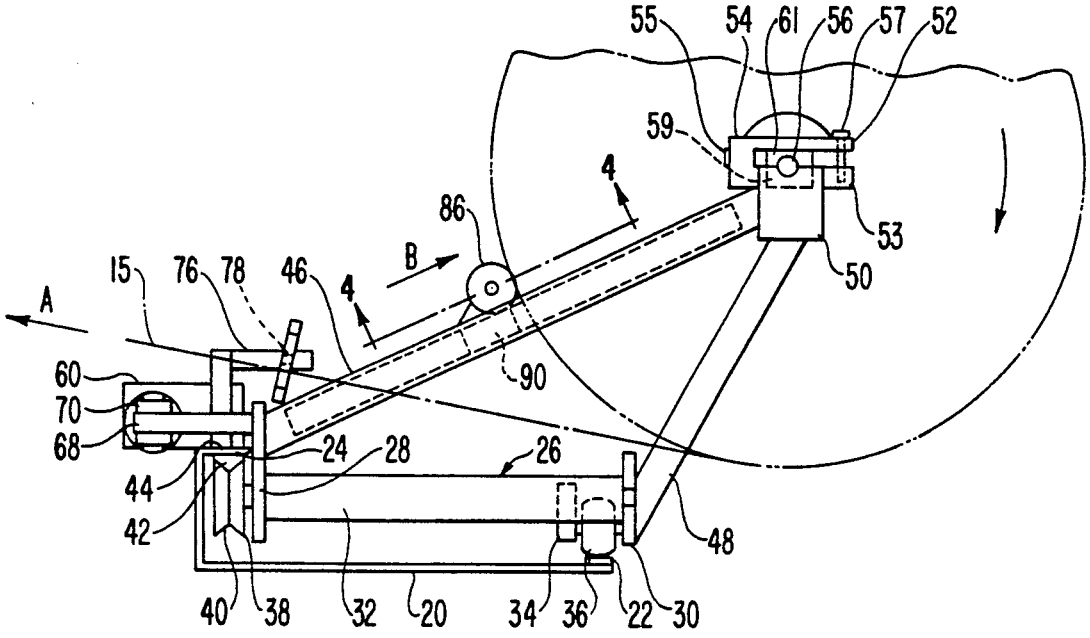
FIG. 3 is a side detailed view of the unwind stand of FIG. 1.

Referring to FIGS. 1, 2 and 3, the cup sidewall stock unwind stand of the present invention indicated generally at 10 includes a stationary frame 14 and a carriage 12 movable between two positions for unwinding rolls of material. In the first unwinding position, as shown in FIG. 1, a roll of stock material 11 mounted on carriage 12 is positioned for unwinding in a direction indicated generally by the arrow A, while the roll of stock material 13, also mounted on carriage 12, is positioned in a standby position. In the second unwinding position, as shown in FIG. 2, roll 11 is moved to a standby position while roll 13 is positioned for unwinding. The rolls or coils of material 11, 13 may be any elongated material which can be effectively rolled into a coil for subsequent unwinding, e.g., paper stock.

As noted above, the unwind stand 10 includes a carriage 12 movably mounted on a stationary frame 14. The carriage 12 is moved laterally or transversely on frame 14 with respect to the unwind direction of the web material (indicated by arrow A). A shifting mechanism 16 moves carriage 12 between the first and second unwinding positions in response to an unwinding position control 17, and, in addition, makes fine adjustments to the carriage 12 position to maintain the web 15 in a predetermined alignment position in response to an alignment detector 18.

Stationary frame 14 is generally rectangular in shape and includes side rails 20 extending between and connecting a rear track 22 with a front track 24. The rear track 22 is generally flat and narrow while front track 24 has an inverted L-shaped cross-section. Frame 14 may be formed from steel or any other material capable of supporting carriage 12 and rolls 11, 13.

Carriage 12 includes a generally rectangularly shaped base portion 26 slidably mounted on frame 14. Base portion 26 includes a front support plate 28 positioned adjacent and parallel to front track 24, and a rear support plate 30 positioned adjacent and parallel to rear track 22. Front support plate 28 and rear support plate 30 are interconnected in generally spaced apart parallel orientation by three transversely oriented support bars 32, equally spaced along the length of plates 28,30. Only one support bar is shown in FIG. 3. Base portion 26 further includes a wheel support bar 34 parallel to but spaced from rear support plate 30. Two rear wheels 36 are mounted between wheel support bar 34 and rear support plate 30 for positioning on rear track 22 of frame 14. Two front wheels 38 are mounted on front support plate 28 opposite rear wheels 36 and include a circumferential V-shaped groove 40 for engaging a ridge 42 formed above wheels 38 on the underside of an overhanging flange portion 44 of front track 24 along the length of front track 24.

As shown in FIGS. 1-3, carriage 12 also includes three front support arms 46 extending upwardly from front support plate 28 and three rear support arms 48 extending upwardly from rear support plate 30. Support arms 46,48 extend upwardly from a plane defined by the support bars 32 of base portion 26. Front support arms 46 extend upwardly and away from shifting mechanism 16 and are joined to the ends of corresponding rear support arms 48 at three points along a line elevated above and rearwardly of rear wheels 36. A boss 50 formed at the connection of each set of support arms 46,48 is adapted to securely receive a lower bearing 59 for supporting an end of one of two shafts 56. A clamp 52 attached to each boss 50 includes a lower portion 53, an upper portion 54, and an upper bearing 61 attached to each upper portion 54. Upper portion 54 is hingedly attached to lower portion 53 by a hinge 55, while a screw 57 is used to releasably secure upper portion 54 to lower portion 53. A set of flanges 58 are mounted on shafts 56 between each of the bosses 50. Each flange 58 may be securely attached to the shafts 56 by a set screw or any other commonly used means for releasably attaching such a part so that it may be easily removed and reattached to the shaft. In this manner, clamps 52 hold shafts 56 in place axially while bearings 59,61 permit shafts 56, flanges 58 and rolls 11,13 to freely rotate together.

Shifting mechanism 16 includes a rod actuator 63 and a servo control actuator 60 for controlling the movement of carriage 12. Rod actuator 63 includes a pneumatic control 65, a lateral cylinder 64 attached to pneumatic control 65 and a rod 62 slidably received in cylinder 64. Rod 62 includes an end portion 66 extending outwardly from cylinder 64 and connected to an extension 68 of carriage 12 by a link 70 and pin 72. Extension 68 is mounted on front plate 28 above overhanging flange 44 of front track 24. Cylinder 64 and rod 62 extend parallel and adjacent to front track 24. Conventional pneumatic control of actuator 63 is a simple and inexpensive means for permitting carriage 12 to be moved between the positions shown in FIGS. 1 and 2 in a quick and uninterrupted fashion since conventional pneumatic cylinders operate to move rod 62 into one of the two positions shown. However, other actuating systems, such as a solenoid actuated rod assembly, which could operate to quickly move a rod between two distinct positions, could be used. Rod actuator 63 can be controlled by manual or automatic controls identified as an Unwinding Position Control 17.

Servo control actuator 60 of shifting mechanism 16 is rigidly attached to front track 24 of stationary frame 14. Actuator 60 is also connected to one end of cylinder 64 by an adjustor link 67 and is thus arranged in series with rod actuator 63 between stationary frame 14 and movable carriage 12. Preferably, actuator 60 is of the electromechanical servo driven type whereby electrical signals received from alignment detector 18, or from other manual controls or automatic detectors mechanically cause small lateral movements of adjustor link 67 and, in turn, cylinder 64 together with rod 62 in the appropriate direction for the desired adjustments to the position of carriage 12. One type of actuator which would be useful in this invention would be a proportional actuator which would displace carriage 12 by an amount which is proportional to the amount of edge misalignment. Therefore, it should be understood that any servo driven type shifting mechanism could be used as long as it is capable of making fine adjustments to the position of the cylinder 64 in each of the unwinding positions of carriage 12. For example, a hydromechanical servo driven system could be used in conjunction with cylinder 64 and rod 62.

Alignment detector 18 includes an edge sensor 74 mounted on an arm 76 which is connected to overhanging flange 44 of front track 24. Since the alignment detector 18 is fixed to stationary frame 14, edge sensor 74 is moved into position adjacent the expected path of the edge of the material to be unwound from either roll 11 or roll 13 as the carriage 12 is mounted into either the first and second unwinding positions, as shown in FIGS. 1 and 2, respectively. The edge sensor 74 is preferably of the photoelectric type and includes a passage 75 formed by a pair of parallel posts 77 sized to admit the edge of the web 15. The arm 76 includes an aperture 78 for receiving a cylindrical extension 82 of sensor 74 and a set screw 80 for adjusting the lateral position of edge sensor 74 on arm 76 to accommodate webs of different widths. In addition, edge sensor 74 may be rotated in aperture 78 to realign passage 75 with the edge of web 15 as the position of the web moves in response to the changing size of the roll during unwinding. The edge sensor 74 is electrically adapted to servo control actuator 60 so that sensor 74 will activate servo control actuator 60 upon any misalignment of web 15 from its alignment position, thereby moving rod 62 in the appropriate direction to cause web 15 to return to its alignment position.

Referring to FIGS. 2 and 3, the unwind stand of the present invention also includes a tensioning system 84 for applying tension to the web of material unwinding from the roll, thereby insuring that only the proper amount of material is pulled from the roll. Tensioning system 84 includes two brake wheels 86, which are each rotatably mounted on a bracket 88. Brackets 88 are, in turn, each connected to a carrier 90 of a respective band or rodless cylinder 92. Each rodless cylinder 92 is of the fluidically operated type and preferably pneumatically operated to move carrier 90 along the axial length of cylinder 92. In this manner, cylinders 92 can be operated to urge the brake wheels 86 against the rolls 11 and 13 in the direction indicated by arrow B to insure that an adequate frictional engagement exists to prevent slippage between the circumferential surface of wheel 86 and the corresponding roll of material. Moreover, the radial tension force exerted against the outer surface of the roll can be adjusted by changing the pressure in cylinder 92. This radial force applied by brake wheels 86 via cylinders 92 acts to retard rotation of the roll of material which ultimately affects the tension in web 15 unwinding from the roll. Therefore, by controlling the pressure in cylinder 92, and, in turn, the radial force applied to the roll of unwound material, the tension in web 15 can be adjusted as desired. The braking effect of the radial force on the rolled material will depend on such variables as the compressibility of the rolled material and the ability of the shafts 56 to freely rotate in the bearings 59,61.

Figure 4:
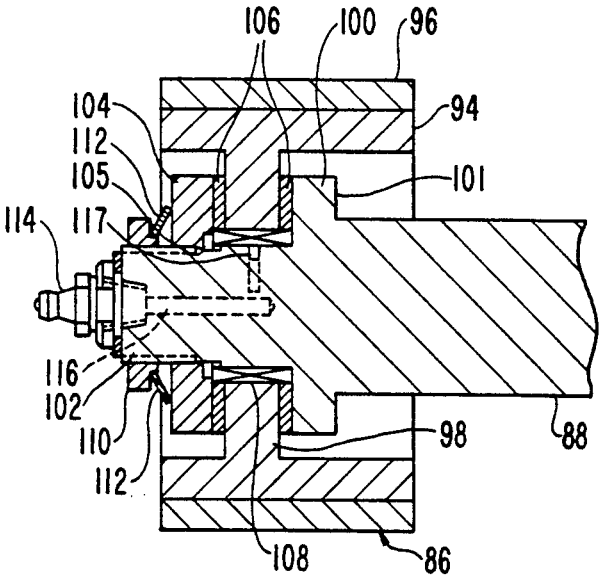
FIG. 4 is a cross sectional view of the roller brake taken along the plane 4—4 in FIG. 3.

Tensioning system 84 also includes a device for adjusting the slip torque of brake wheels 86 which, in turn, controls the tension on web 15. As shown in FIG. 4, each brake wheel 86 includes a spool piece 94 having an outer layer 96 made of rubber or other material having a high coefficient of friction. Spool piece 94 includes a circumferential flange 98 extending radially inward towards the axis of brake wheel 86. A stationary hub 100 is integrally formed on the end of bracket 88 and includes a circumferential flange 101 extending radially outward and an axially extending threaded end portion 102. An axially movable brake plate 104 having an aperture 105 is positioned opposite flange 101 so that end portion 102 extends through aperture 105. Brake plate 104 is keyed to end portion 102 to permit axial movement, but prevent rotation thereabout. In this manner, flange 98 of spool piece 94 is positioned between flange 101 and brake plate 104. The surfaces of flange 101 and plate 104 which contact flange 98 are provided with friction discs 106. Also, a needle bearing 108 is positioned between brake wheel 86 and end portion 102 to allow brake wheel 86 to smoothly rotate. A nut 110 threaded onto end portion 102 is used to force a belleville type spring 112 against brake plate 104, which in turn acts against flange 98 and stationary flange 101. As a result, the ability of brake wheel 86 to rotate can be controlled by adjusting nut 110 which controls the spring force applied to brake plate 104 which thereby controls the braking force applied to flange 98. The further nut 110 is threaded onto end portion 102 the greater the braking force applied to flange 98 by friction discs 106. It should be noted that a grease fitting 114 and a series of passages 116 and 117 are provided to maintain lubrication of needle bearing 108.

It can be seen from the foregoing that the tension in a web unwinding from a roll can be easily adjusted by controlling the radial force of the respective brake wheel 86 against the roll of material by changing the pressure in the corresponding band cylinder 92. In addition, the tension in web 15 can further be adjusted by controlling the braking force applied to brake wheels 86. Therefore, this tensioning system allows for a broad range of tension values to be applied to web 15 to insure proper unwinding depending on the particular circumstances such as the size, type and weight of the material and the speed of the unwinding process.

Referring to FIG. 1, during the operation of the unwind stand in the first unwinding position, roll 11 is positioned for unwinding in the direction indicated by arrow A. During this time, roll 13 can be loaded onto shaft 56 by removing the screw 57 of the respective clamps 52 to allow the respective shaft 56 to be removed. Flanges 58 can then be removed and roll 13 positioned on shaft 56. Flanges 58 are then replaced to align roll 13 along the axial length of shaft 56. The shaft and roll assembly is then repositioned in clamps 52 and screw 57 retightened. In addition, while roll 11 is unwinding, edge sensor 74 of alignment detector 18 continues to determine the misalignment of web 15 in relation to a predetermined alignment of position. When necessary, edge sensor 74 signals servo control actuator 60 to move cylinder 64, thereby shifting carriage 12 laterally in the appropriate direction to realign web 15 in the proper alignment position. In addition, tension in web material 15 can be maintained by adjusting the pressure in the appropriate cylinder 92, thereby controlling the radial force of brake wheel 86 against roll 11. Also, the slip torque of brake wheel 86 can be controlled by adjusting nut 110, thereby adjusting the braking force on roll 11 and, therefore, the tension imparted to web 15. Once roll 11 is depleted to the point where a new roll is required, rod actuator 63 is operated to cause rod 62 to move carriage 12 laterally into the second unwinding position as shown in FIG. 2. The fluid pressure in the cylinder 92 corresponding to roll 11 can be decreased to allow the respective brake wheel 86 to move along cylinder 92 away from the remainder of roll 11. For each roll, edge sensor 74 can be adjusted using set screw 80 to insure the proper position with respect to the edge of web 15. In the second unwinding position, roll 11 can be removed and replaced by a new roll in the same manner as described above with respect to roll 13. Again, during the unloading and loading of roll 11, servo control actuator 60 of shifting mechanism 16 is used in conjunction with alignment detector 18 to make fine adjustments to the lateral position of cylinder 64 and rod 62, and, in turn, carriage 12 and roll 13, so as to maintain web 15 in an alignment position during unwinding.

Industrial Applicability

The present invention provides an unwind stand for quick and effective control of unwinding operations for many types of rolled materials. The unwind stand can be used in a variety of manufacturing operations using rolled material or wherever a quick and effective unwinding process is desired.

I claim:

1. An unwind stand for rolled material comprising:

a movable supporting means for supporting at least two rolls of material, said supporting means including a first roll holding means and a second roll holding means for holding a first roll of material and a second roll of material respectively;

a shifting means including a shifting mechanism connected to said movable supporting means for shifting said movable supporting means between a first unwinding position in which a first roll of material received by said first roll holding means is positioned for unwinding and a second unwinding position in which a second roll of material received by said second roll holding means is positioned for unwinding;

an alignment detecting means for detecting the position of the material unwinding from a roll relative to an unwinding material alignment position, said alignment detecting means operatively connected to said shifting mechanism and adapted to actuate movement of at least a portion of said shifting mechanism for adjusting said movable supporting means to maintain the material in said alignment position, wherein the material unwinding from a roll travels in an unwinding direction and said shifting mechanism shifts said movable supporting means laterally with respect to the unwinding direction.

2. The stand of claim 1, further including a stationary frame, said supporting means being movably mounted on said stationary frame.

3. The stand of claim 2, wherein said first roll holding means and said second roll holding means each includes a shaft for rotatably supporting a roll of material.

4. The stand of claim 3, wherein said supporting means includes a base portion positioned adjacent said frame and a plurality of support arms connected to and extending upwardly from said base portion, said support arms adapted to support said shafts.

5. The stand of claim 4, further including clamping means for releasably attaching said shafts to said support arms.

6. The stand of claim 4, further including a roller means for movably mounting said supporting means on said stationary frame.

7. The stand of claim 6, wherein said frame includes an overhanging flange portion and said roller means includes a first pair of wheels and a second pair of wheels, said first pair of wheels being urged downwardly into contact with said frame and said second pair of wheels being urged upwardly into contact with said overhanging flange portion of said frame.

8. The stand of claim 4, further including tensioning means mounted on said movable supporting means for applying tension to the material, said tensioning means including a braking means in contact with the rolls of material mounted on said shafts for applying a braking force to the roll and a tension adjusting means connected to said braking means for adjusting the tension on the material.

9. The stand of claim 8, wherein said braking means includes at least one rotatable wheel and said tension adjusting means includes at least one cylinder and at least one carrier, said at least one carrier slidably mounted on said at least one cylinder, said at least one cylinder and said at least one carrier adapted to adjustably urge said at least one rotatable wheel into contact with at least one of the rolls of material.

10. The stand of claim 9, wherein said at least one cylinder is mounted on one of said support arms, said at least one cylinder and said at least one carrier arranged to urge said at least one wheel upwardly away from said frame against a roll of material.

11. The stand of claim 9, wherein said tension adjusting means further includes a slip torque adjusting means for controlling the ability of said rotatable wheel to rotate, said slip torque adjusting means including a pair of friction disks surrounding a portion of said wheel and a spring for adjustably compressing at least one of said pair of friction disks against said wheel.

12. The stand of claim 1, wherein the material unwinding from a roll travels in an unwinding direction and said shifting means shifts said movable supporting means laterally with respect to the unwinding direction.

13. The stand of claim 1, wherein said shifting mechanism includes a first actuating means for moving said movable supporting means between said first unwinding position and said second unwinding position, and a second actuating means for adjusting the position of said movable supporting means to maintain the material in said alignment position.

14. The stand of claim 13, wherein said first actuating means includes a rod and a cylinder, said rod having a first end connected to said movable supporting means and a second end slidably received within said cylinder, said cylinder being movably connected to said second actuating means.

15. The stand of claim 14, wherein said first actuating means includes a pneumatic control for pneumatically moving said rod relative to said cylinder, and said second actuating means is an electromechanically servo driven actuator adapted to adjust the position of said cylinder laterally with respect to said unwinding direction of the material.

16. The stand of claim 1, wherein said alignment detecting means includes an edge sensing means for sensing the position of at least one edge of the unwinding material.

17. An unwind stand for rolled material comprising:

a stationary frame;

a carriage movably mounted on said stationary frame for supporting at least one roll of coiled material, said carriage means including at least one roll holding means for rotatably holding a roll of material;

a carriage shifting means including a shifting mechanism for shifting said carriage between an unwinding position in which a roll of material positioned in said at least one rolling holding means is positioned for unwinding and a stand-by position in which the roll of material positioned in said at least one roll holding means is moved substantially out of said unwinding position;

an alignment detecting means for detecting the position of the material unwinding from a roll when in said unwinding position relative to an unwinding means operatively connected to said shifting mechanism and adapted to actuate movement of at least a portion of said shifting mechanism for adjusting said carriage to maintain the material in said alignment position, wherein the material unwinding from a roll positioned in said unwinding position travels in an unwinding direction and said shifting mechanism shifts said movable supporting means laterally with respect to said unwinding direction.

18. The stand of claim 17, wherein the material unwinding from a roll positioned in said unwinding position travels in an unwinding direction and said shifting means shifts said movable supporting means laterally with respect to said unwinding direction.

19. The stand of claim 18, wherein said shifting mechanism includes a first actuating means for moving said carriage between said unwinding position and said stand-by position, and a second actuating means for adjusting the position of said carriage to maintain the material in said alignment position.

20. The stand of claim 19, wherein said first actuating means includes a rod and a cylinder, said rod having a first end connected to said carriage means and a second end slidably received within said cylinder, said cylinder being movably connected to said second actuating means.

21. The stand of claim 20, wherein said first actuating means includes a pneumatic control for pneumatically moving said rod relative to said cylinder, and said second actuating means is an electromechanically servo driven actuator adapted to adjust the position of said cylinder laterally with respect to said unwinding direction of the material.

22. The stand of claim 17, wherein said at least one roll holding means includes a shaft for rotatably supporting the roll of material.

23. The stand of claim 22, wherein said carriage means includes a base portion positioned adjacent said frame and a plurality of support arms connected to and extending upwardly from said base portion, said support arms adapted to support said shaft.

24. The stand of claim 23, further including tensioning means mounted on said carriage means for applying tension to the material, said tensioning means including a braking means in contact with the roll of material mounted on said shaft for applying a braking force to the roll and a tension adjusting means connected to said braking means for adjusting the tension on the material by adjusting said braking force.

25. The stand of claim 24, wherein said braking means includes at least one rotatable wheel and said tension adjusting means includes at least one cylinder and at least one carrier, said at least one carrier slidably mounted on said at least one cylinder, said at least one cylinder and said at least one carrier adapted to adjustably urge said at least one rotatable wheel into contact with at least one of the rolls of material.

26. The stand of claim 25, wherein said at least one cylinder is mounted on one of said support arms, said at least one cylinder and said at least one carrier arranged to urge said at least one wheel upwardly away from said frame against the roll of material.

27. The stand of claim 26, wherein said tension adjusting means further includes a slip torque adjusting means for controlling the ability of said rotatable wheel to rotate, said slip torque adjusting means including a pair of friction disks surrounding a portion of said wheel and a spring for adjustably compressing at least one of said pair of friction disks against said wheel.

28. The stand of claim 17, wherein said alignment detecting means includes an edge sensing means for sensing the position of at least one edge of the unwinding material.

29. An unwind stand for rolled material comprising:

a supporting means for rotatably supporting at least one roll of material;

a tensioning means mounted on said supporting means for applying substantially continuous tension to the material unwinding from said at least one roll of material, said tensioning means including a braking means in contact with an outer rolled layer of a roll of material mounted on said supporting means for applying a generally radial force to the roll;

a tension adjusting means operatively connected to said braking means for adjusting the tension in the material by adjusting said radial force applied by said braking means, said tension adjusting means including at least one cylinder and at least one carrier slidably mounted on said at least one cylinder, said at least one carrier adapted to linearly move said braking means relative to the roll of material to control the amount of said radial force applied to said outer rolled layer of the roll.

30. An unwind stand for rolled material comprising:

a supporting means for rotatably supporting at least one roll of material;

a tensioning means mounted on said supporting means for applying tension to the material, said tensioning means including a braking means in contact with a roll of material mounted on said supporting means for applying a generally radial force to the roll;

a tension adjusting means operatively connected to said braking means for adjusting the tension in the material by adjusting said radial force applied by said braking means, said tension adjusting means including at least one cylinder and at least one carrier mounted on said supporting means, said at least one carrier slidably mounted on said at least one cylinder and adapted to linearly move said braking means relative to the roll of material to control the amount of said radial force applied to the roll, wherein said braking means includes at least one rotatable wheel connected to said at least one carrier of said at least one cylinder.

31. The stand of claim 30, further including a shaft connected to said supporting means for rotatably supporting the roll of material, wherein said supporting means includes a base portion and a plurality of support arms connected to and extending upwardly from said base portion, said support arms adapted to support said shaft.

32. The stand of claim 30, wherein said tension adjusting means further includes a slip torque adjusting means for controlling the ability of said rotatable wheel to rotate, said slip torque adjusting means including a pair of friction disks surrounding a portion of said wheel and a spring for adjustably compressing at least one of said pair of friction disks against said wheel.

* * * * *